US006572223B2

(12) United States Patent
Delametter et al.

(10) Patent No.: US 6,572,223 B2
(45) Date of Patent: Jun. 3, 2003

(54) APPARATUS AND METHOD OF BALANCING END JET FORCES IN AN INK JET PRINTING SYSTEM

(75) Inventors: Christopher N. Delametter, Rochester, NY (US); Gilbert A. Hawkins, Mendon, NY (US); James M. Chwalek, Pittsford, NY (US); Charles F. Faisst, Jr., Avon, NY (US); Yung-Rai R. Lee, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 7 days.

(21) Appl. No.: 09/813,580

(22) Filed: Mar. 21, 2001

(65) Prior Publication Data

US 2002/0135637 A1 Sep. 26, 2002

(51) Int. Cl.[7] ..... B41J 2/02

(52) U.S. Cl. ..... 347/82; 347/47

(58) Field of Search ..... 347/47, 73, 74, 347/82

(56) References Cited

U.S. PATENT DOCUMENTS 5,175,567 A * 12/1992 Asai ..... 347/47
5,966,154 A * 10/1999 DeBoer ..... 347/82

* cited by examiner

*Primary Examiner*—Anh T. N. Vo
(74) *Attorney, Agent, or Firm*—William R. Zimmerli

(57) ABSTRACT

An inkjet printing apparatus is provided. The apparatus includes a source of ink and a printhead. The printhead includes an end nozzle and a second nozzle adjacent to the end nozzle. A portion of the printhead is shaped to balance forces acting on the ink ejected from the end nozzle.

44 Claims, 8 Drawing Sheets

APPARATUS AND METHOD OF BALANCING END JET FORCES IN AN INK JET PRINTING SYSTEM

This invention relates generally to the field of continuous ink jet print head design. More specifically, it relates to improving print resolution by redesigning the ink flow patterns emanating from printhead nozzles.

BACKGROUND OF THE PRIOR ART

Traditionally, digitally controlled ink jet printing capability is accomplished by one of two technologies. Typically, ink is fed through channels formed in a printhead. Each channel includes a nozzle from which ink drops are selectively ejected and deposited upon a medium.

The first technology, commonly referred to as "drop on demand" ink jet printing, provides ink drops for impact upon a recording surface using a pressurization actuator (thermal, piezoelectric, etc.). Selective activation of the actuator causes the formation and ejection of a drop that crosses the space between the printhead and the print media and strikes the print media. The formation of printed images is achieved by controlling the individual formation of ink drops, as is required to create the desired image. Typically, a slight negative pressure within each channel keeps the ink from inadvertently escaping through the nozzle, and also forms a slightly concave meniscus at the nozzle.

The second technology, commonly referred to as "continuous stream" or "continuous" ink jet printing, uses a pressurized ink source which produces a continuous stream of ink drops. Conventional continuous inkjet printers utilize electrostatic charging devices that are placed close to the point where a filament of working fluid breaks into individual ink drops. The ink drops are electrically charged and then directed to an appropriate location by deflection electrodes having a large potential difference. When no print is desired, the ink drops are deflected into an ink capturing mechanism (catcher, interceptor, gutter, etc.) and either recycled or disposed of. When a print is desired, the ink drops are not deflected and are thereby allowed to strike a print media. Alternatively, deflected ink drops may be allowed to strike the print media, while non-deflected ink drops are collected in the ink capturing mechanism.

U.S. Pat. No. 6,079,821, issued to Chwalek et al., on Jun. 27, 2000, discloses a continuous ink jet printer that uses actuation of asymmetric heaters to create individual ink drops from a filament of working fluid and deflect those ink drops. A printhead includes a pressurized ink source and an asymmetric heater operable to form printed ink drops and non-printed ink drops. Printed ink drops flow along a printed ink drop path ultimately striking a print media, while non-printed ink drops flow along a non-printed ink drop path ultimately striking a catcher surface. Non-printed ink drops are recycled or disposed of through an ink removal channel formed in the catcher.

Traditionally, ink jet nozzles for both "drop on demand" and "continuous" ink jet printheads are formed in an array or row, often a linear array or row, and fixed in a single plane, the nozzles in a row being equally spaced. A row of nozzles is comprised of "end nozzles" (commonly referred to as end jets, etc.) which are nozzles at each end of the row, and "inner nozzles" positioned inside the end nozzles within the row. The ink streams and ink drops ejected from end nozzles and inner nozzles, respectively, are referred to as end streams and end drops and as inner streams and inner drops, respectively. As such, one would expect the pattern of printed ink drops 20, printed on a recording medium 22, to mirror the pattern of the nozzles of the linear array, as shown in FIG. 1*a*. However, it has been observed that ink stream flow patterns of end nozzles are out-of-line or incongruent when compared to ink stream flow patterns of inner nozzles, resulting in a failure of the pattern of printed ink drops 20, printed on a recording medium 22, to mirror the pattern of the nozzles of the linear array. Referring to FIG. 1*b* printed ink drops 21, ejected from end nozzles, are printed on the recording medium at a location displaced perpendicularly relative to other printed ink drops 20, ejected from inner nozzles. This perpendicular direction is commonly referred as a "fast scan" direction, since many commercial printers scan the printhead rapidly over a recording medium in this direction to print a pattern of drops known as an image swath. The reduction in ink drop placement accuracy degrades the printing performance of the end nozzles and of the printhead. Additionally, ink drop misplacement in the fast scan direction causes a reduction in overall image print quality.

It was theorized in the late 1970's and early 80's that this problem in print resolution stemmed from the fact that ink drops or ink streams ejected from end nozzles, positioned at an end of the nozzle array, were exposed to the ambient air, more so than ink drops or ink streams ejected from inner nozzles, positioned within the nozzle array. Ink ejected form end nozzles was thought to be subjected to aerodynamic drag, a force directed in a line along the trajectory of the ink drops but opposing their motion. This force reduced the velocity of streams of ink or ink drops ejected from end nozzles relative to the velocity of ink streams or ink drops ejected from inner nozzles. Thus, ink drops 21 ejected from end nozzles were caused to strike the print medium 22 at a later time than ink drops 20 ejected from inner nozzles. The resultant printed image of printed ink drops ejected from a linear array of nozzles was curved rather than in a straight line (see FIG. 1*b*), as desired, thus creating image artifacts and reducing image resolution. Such aerodynamic drag could reduce resolution in all inkjet printers including drop on demand and continuous ink jet printers.

In order to improve print resolution, various efforts were directed toward compensating for the velocity reduction due to aerodynamic drag. A substantially uniform line of ink drops from all of the in-line nozzles of the multi-nozzle array, was desired, and it was reasoned the if end drops could be made to strike the recording medium at the desired location by compensation for drag, higher print resolution would result.

Methods for correcting the printed location of end drops have been disclosed in "Reducing Drop Misregistration from Differential Aerodynamic Retardation in a Linear Ink Jet Array," IBM Technical Disclosure Bulletin, Volume 17, No. 10 by D. E. Fisher and D. L. Sipple as early as March of 1975. One correction method used control algorithms to vary the time of flight of drops from the nozzle to the recording medium and thus to cause an ink stream curvature opposite to that caused by the aerodynamic drag. A method set forth for correcting the effects of aerodynamic drag was to use a compensating velocity across the array. Alternatively, a decreased path length was found to similarly compensate.

U.S. Pat. No. 3,562,757, issued to Bischoff, corrected for drag on a drop-to-drop basis. Every other drop was guttered thereby increasing the distance between drops used for printing so that the all drops experienced some drag.

U.S. Pat. No. 3,596,275, issued to Sweet, disclosed use of an extraneous collinear stream of air with the stream of ink drops to reduce the effects aerodynamic drag. A fan, or the like, was necessary to generate the airflow.

U.S. Pat. No. 4,077,040, issued to Hendriks, reduced the effect of aerodynamic retardation or drag between streams by utilizing drop streams on the perimeter of the array which were never printed but instead continually guttered to produce a counter airflow tending to reduce retardation of drop streams emitted from the other nozzles.

U.S. Pat. No. 4,185,290, issued to Hoffman, caused each of the streams of drops ejected from end nozzles at each end of the array to have an initial velocity higher than the initial velocity of the streams of drops ejected form inner nozzles inside the end nozzles of the array, thereby compensating for the aerodynamic drag on ink streams at the end of the array. The higher initial velocity of drops ejected from the end nozzles was made possible by changing the length of the longitudinal passages in those nozzles.

Recently, continuous ink jet print heads have been made with increased nozzle densities, for example nozzle densities of 1200 nozzles per inch and higher. As nozzle densities and printing speeds have increased, the ability to reduce image artifacts and to achieve finer resolution, by merely compensating for the aerodynamic drag on ink streams at the end of the array, has proven insufficient. The difficulties have arisen, in part because, higher density printing gives rise not only to a need for correcting displacement of ink drops in the fast scan direction, shown in FIG. 1*b*, but also to a need for correcting displacement of ink drops perpendicular to the fast scan direction, that is, in a slow scan direction, as shown in FIG. 1*c*. The term slow scan direction is known and used in the art of commercial desktop printer design. In most desktop printers, the printhead is first scanned rapidly in the fast scan direction to print an image swath, then stepped or moved a small amount in a direction perpendicular to the fast scan direction (the slow scan direction) before another fast scan is repeated to print a subsequent image swath.

Referring to FIG. 1*d*, an example of misalignment of printed ink drops in the slow scan direction, often encountered when printing with a high-density line of ink jet nozzles, is shown. An ink jet print head 24 includes a nozzle plate 26 having an array of inner nozzles 38 and end nozzles 36 each spaced apart equally one from another by a predetermined spacing D. Typically, spacing D is small in a high density nozzle row, for example 30 microns or less. Printhead 24 ejects ink 30 from an ink delivery channel 33 through nozzles 36 and 38 onto a recording medium 22. Initially, the ink 30 is ejected in the form of an ink streams 32*a*, 32*b* which subsequently breaks into or forms a stream of individual ink drops 34. Ideally, ink drops 34 travel to recording medium 22 and form printed drops 20 by impinging on recording medium 22 in a substantially equally spaced straight line (shown in FIG. 1*a*).

However, as shown in FIG. 1*d* and FIG. 1*c*, printed ink drops 23 printed from end nozzles 36 suffer displacement 40 (commonly referred to as misalignment, misdirection, etc.) in the slow scan direction, particularly in high density inkjet printers. In other words, ink 30 ejected from an end nozzle 36 is deflected toward an adjacent inner nozzle 38. Ink drops 34 from end nozzle 36 and adjacent inner nozzle 38 impinge on a recording medium 22 in close proximity, in particular they are spaced closer than D, by an amount E, whereas ink drops 34 from any two adjacent inner nozzles 38 impinge on recording medium 22 and are spaced a distance D apart. Thus the spacing E represents the amount of misalignment of the printed drop from end nozzle 36 and is typically a fraction of D. In some cases, misalignment in the slow scan direction can even cause ink streams 32*a*, 32*b* or ink drops 34 ejected from end nozzles to collide with drops ejected from adjacent nozzles prior to impinging on recording medium 22, causing additional image artifacts.

The initial stream trajectory 50 of all ink steams 32 in FIG. 1*d* is shown pointing vertically, including end nozzle 36. The initial stream trajectory 50 is defined as the average stream velocity at the base of the stream as the stream exits the nozzle. Initial stream trajectory 50 depends only on the geometry of the nozzles 36 or 38 and on the geometry of the printhead 24 at or below nozzle plate 36. If no other forces acted on ink streams 32*a*, 32*b* and ink drops 34; then, for an initial stream trajectory 50 which is vertical, the ink drops 34 would travel vertically in FIG. 1*d*.

Misalignment of ink drops in the slow scan direction can be explained by examining the forces acting on each ink stream 32*a*, 32*b* and associated ink drops 34 as they travel to recording medium 22. In particular, misalignment in the slow scan direction can be explained as an imbalance between interactive forces F1 and F2, shown in FIG. 1*d*, acting upon an end nozzle 36, in comparison with a balance between interactive forces F1 and F2, acting upon an inner nozzle 38. Forces F1 and F2 are caused by the pressure of air surrounding each ink stream 32*a*, 32*b* and associated ink drops 34. Force F1 acts on a given ink stream 32*a*, 32*b* and ink drops 34 in a direction left, as viewed in FIG. 1*d*, and is caused, as will be explained, by air currents to the right of that ink stream. Force F2 acts on a given ink stream 32*a*, 32*b* and ink drops 34 in a direction right, as viewed in FIG. 1*d*, and is caused by air currents to the left of that ink stream. The air currents cause a deviation of the air pressure from its atmospheric pressure value according to principles to be described. For inner nozzles 38, the air currents producing forces F1 and F2 on any given ink stream 32*a*, derive from the motion of the right and left neighboring ink streams 32*a*, 32*b*, respectively. For inner nozzles 38, F1 and F2 are essentially identical and hence produce no net force F1–F2. For end nozzle 36 shown in FIG. 1*d*, the air currents producing force F2 derive from the motion of the left neighboring ink stream 32*a* and the value of F2 for end nozzle 36 is not too different from the value of F2 associated with an inner nozzle 38. However, the air currents producing force F1 for end nozzle 36 are different from those associated with an inner nozzle 38, since there is no stream to the right of end nozzle 36. For end nozzle 36, F1 and F2 are not identical and hence there is a net force F1–F2. As will be explained quantitatively, F1 for the end nozzle 36 exceeds F1 for the inner nozzles 38. The force F1 associated with the right most ink stream in FIG. 1*d* is therefore represented as a longer arrow and the net force F1–F2 on end nozzle 36 is directed left.

When interactive forces F1 and F2 are balanced, for example in the case of an inner nozzle 38, such that there is no net force on the ink stream 32*a* or ink drops 34, the ink stream 32*a* and ink drops 34 remain undeflected in the slow scan direction (left-right in FIG. 1*d*) and a desired printed ink drop 20 spacing is maintained. When interactive forces F1 and F2 are unbalanced, for example in the case of end nozzle 36, such that there is a net force directed left on the ink stream 32*b* and on the ink drops 34 ejected from end nozzle 36, the ink stream 326 and ink drops 34 are deflected left in the slow scan direction (left in FIG. 1*d*) and the desired printed ink drop 23 spacing is not maintained. Thus, because there is no nozzle on the other side of end nozzle 36, ink drops 34 ejected by end nozzle 36 are misdirected and land on printed locations displaced from a desired location shown at 40. The trajectory followed by ink stream 32*b* and ink drops 34 ejected by end nozzle 36 curves continuously from the end nozzle 36 to recording medium 22 because the forces F1 and F2 are unbalanced all along the trajectory, as will be discussed. It is important to note that misalignment of printed drops due to this curved trajectory is distinct from the hypothetical case which would occur if the interactive forces were balanced but the ejected stream was initially misdirected by a mechanism inherent in the printhead, for example by virtue of a physical manufacturing defect, in a direction left of vertical in FIG. 1*d*. In such a case, the drops so ejected would also fail to land at the desired location, but the trajectory would be straight.

Interactive forces F1 and F2 act on each member of a given pair of ink streams 32*a*, 32*b* to determine their trajectories and in so doing also determine the air volume between them. For example, for the second and third streams from the right in FIG. 1*d*, both ejected from inner nozzles (inner streams 32*a*), the balanced forces F1 and F2 influence the trajectories of each stream to be straight lines and thus create a balanced air volume 42 between the second and third streams. This balanced air volume is the same for all pairs of adjacent inner streams 32*a*, and in these cases, the printed ink drops 20 are not misaligned. For the case of two adjacent ink streams 32*a*, 32*b* one of which is ejected from end nozzle 32*b* (end stream 32*b*) and the other of which is ejected from inner nozzle 38 (inner stream 32*a*), such as the first and second streams from the right in FIG. 1*d*, the forces F1 and F2 are unbalanced. Unbalanced forces F1 and F2 alter the trajectory on the end ink stream 32*b* ejected from end nozzle 36 and thus create an unbalanced air volume 44, causing the printed ink drops 23 to be misaligned (location 40) in the slow scan direction by an amount E. Because of the shape of the unbalanced air volume 44 to the left side of end nozzle 36, the force F2 on the end stream 32*b* (first stream on the right in FIG. 1*d*) is slightly larger than the force F2 on inner nozzles 38 having balance air volumes to their left sides. The force F2 acting on end stream 32*b* is slightly larger than the force F2 on inner streams 32*a* ejected from inner nozzles 38 because the unbalanced air volume 44 provides a greater separation between the end stream 32*b* and the neighboring inner ink stream 32*a* than does a balanced air volume 42, the resulting reduction in air velocity near the end stream 32*b* arising from this greater separation causes the air pressure to be closer to its atmospheric value. The term "interactive force" is thus used to emphasize that forces F1, F2 interactively influence the ink steam and ink drop trajectories. These forces determine the shape of the air volumes between neighboring ink streams, which in turn influence the forces F1, F2 themselves.

Misalignment of ink drops in the slow scan direction can not be adequately corrected by compensating for aerodynamic drag using printing methods and printhead configurations that alter the ink drop velocity at end nozzles or provide for a later time of delivery for ink drops ejected from nozzles positioned proximate or at an end of the nozzle array. Additionally, adequate correction can not be obtained by other methods of compensating for aerodynamic drag, including displacement of end nozzles in the fast scan direction. This is especially evident in continuous ink jet systems having increased ink drop velocities and in inkjet systems having high density nozzle arrays.

Additionally, correcting misalignment of ink drops in the slow scan direction cannot be achieved by previous methods that compensate for ink drop misalignment caused by aerodynamic drag. For example, lower drop velocities are not sufficient to account for ink drop misalignment in the fast scan direction. It is however, important to correct for these problems, especially in high-density nozzle printing because, for example, in severe cases end drops may be so misaligned as to collide with drops ejected from neighboring nozzles before landing on the receiver. Accordingly, an apparatus and method of overcoming incongruent ink stream flow patterns at the end of the nozzle array in the fast scan and slow scan directions would be a welcomed advancement in the art.

SUMMARY OF THE INVENTION

An object of the present invention is to correct misdirection of ink streams and ink drops in a slow scan direction of an ink jet printhead.

Another object of the present invention to correct misdirection of ink streams and ink drops in a slow scan direction of an ink jet printhead having high nozzle densities.

Another object of the present invention is to provide a compensating or additional air sheath to correct misdirection of ink streams and ink drops.

Another object of the present invention is to prevent collisions between adjacent ink streams or ink drops prior to ink drops impinging on a recording medium.

Yet another object of the present invention to provide a high-density multiple nozzle array printhead having improved image resolution.

Yet another object of the present invention to provide a high-density multiple nozzle array printhead without the need for collinear air flow.

Yet another object of the present invention to provide a high-density multiple nozzle array with improved resolution without the need for permanently adjusting jet velocities of end nozzles.

Yet another object of the present invention to provide a means of high-density nozzle array design which simultaneously corrects misregistration in both the slow scan and fast scan directions providing improved resolution without need for permanently guttering the ink stream from the end nozzle.

According to an object of the present invention, an inkjet printing apparatus includes a source of ink and a printhead. The printhead has an end nozzle and a second nozzle adjacent to the end nozzle. A portion of the printhead is shaped to balance forces acting on the ink ejected from the end nozzle.

According to another object of the present invention, a printhead includes housing. Portions of the housing define a plurality of nozzle bores including an end nozzle bore and a second nozzle bore adjacent to the end nozzle bore. A portion of the housing is shaped to balance forces acting in a substantially s perpendicular direction relative to a path of ink ejected through the end nozzle bore and the adjacent nozzle bore as viewed from a plane substantially perpendicular to a plane defined by the ejected ink.

According to another object of the present invention, a method of balancing forces acting on ink ejected from an end nozzle includes providing a printhead having a plurality of nozzles including an end nozzle; and shaping a portion of the printhead such that forces acting on the ink ejected from the end nozzle are balanced, whereby ink drops formed from the ink ejected by the printhead are substantially equally spaced apart at a location removed from the printhead.

DETAILED DESCRIPTION OF THE INVENTION

The present description will be directed to elements forming part of, or cooperating more directly with, apparatus in accordance with the present invention. It is to be understood that elements not specifically shown or described may take various forms well known to those skilled in the art.

Figure 1A:
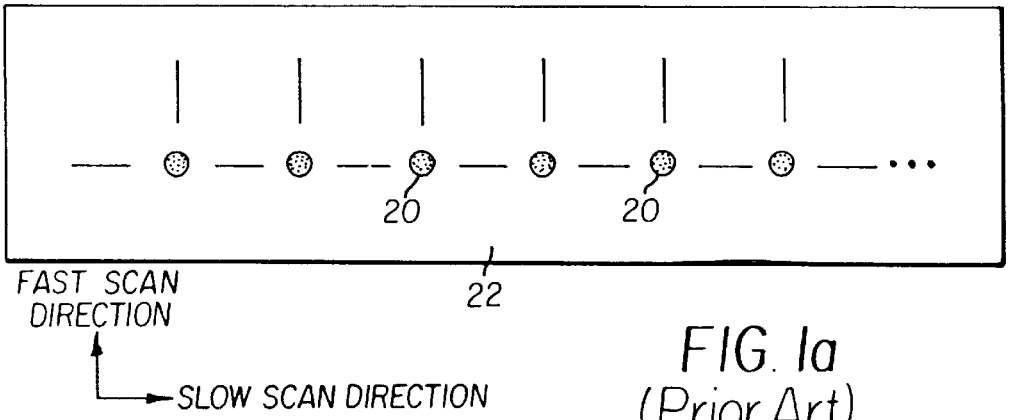
FIG. 1a (Prior Art)
FIGS. 1*a*–1*c* are top views of printed ink drops showing acceptable ink drop alignment, ink drop misalignment in a fast scan direction from an end nozzle, and ink drop misalignment in a slow scan direction from and end nozzle, respectively.
Figure 1B:
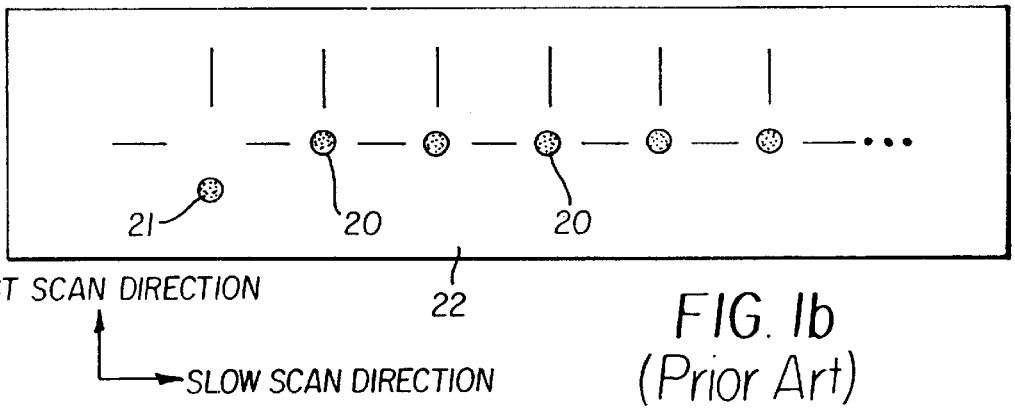
FIG. 1b (Prior Art)
Figure 1C:
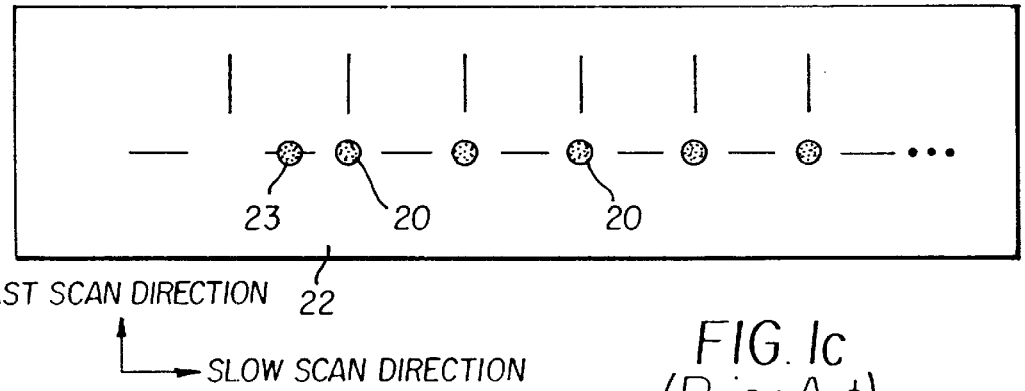
FIG. 1c (Prior Art)
Figure 1D:
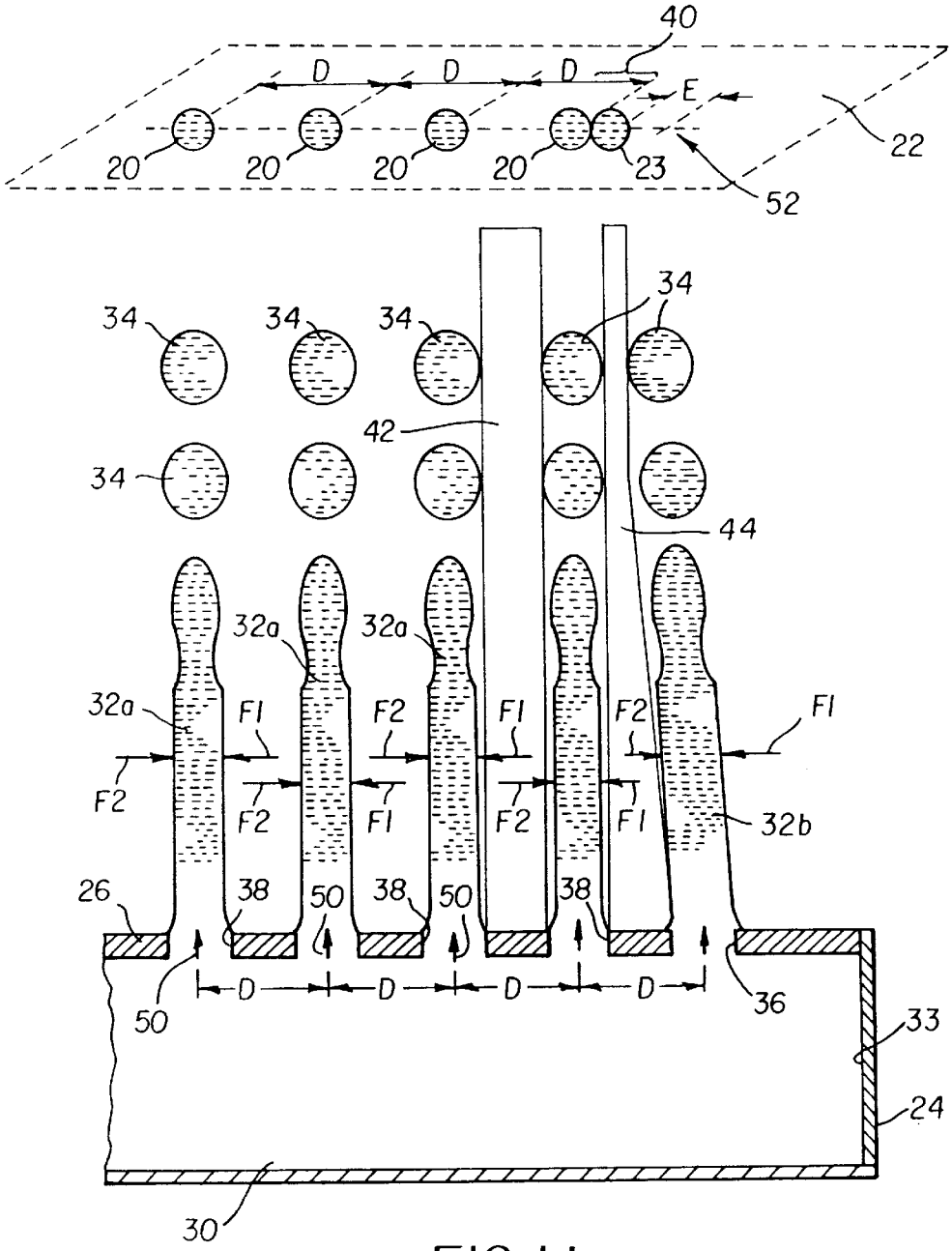
FIG. 1d (Prior Art)
FIG. 1*d* is a cross-sectional view of a high-density inkjet printhead and printed ink drops having ink drop misalignment in a slow scan direction from and end nozzle.
Figure 1E:
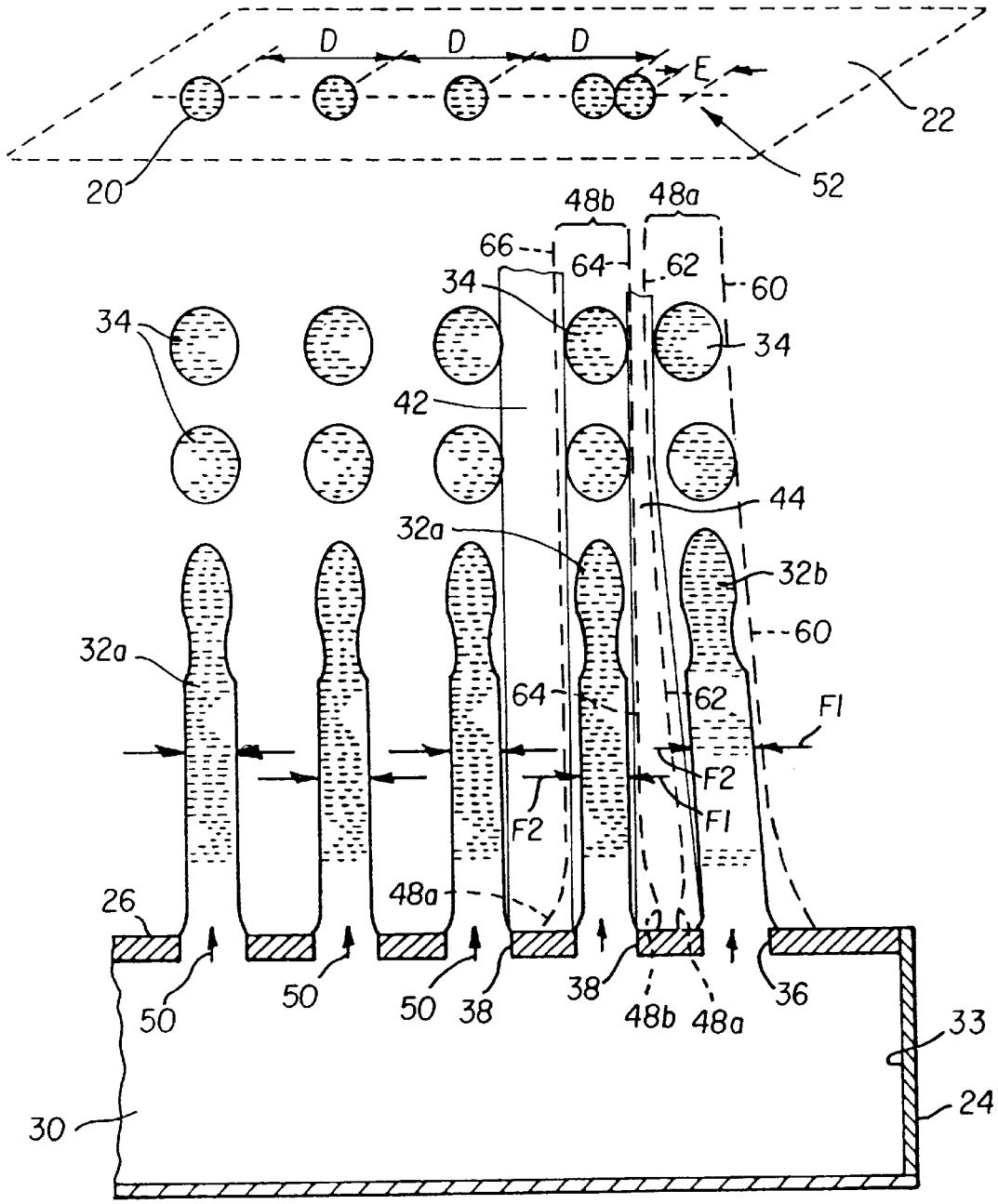
FIG. 1*e* shows streamline regions of an end nozzle and an adjacent inner nozzle.

Referring to FIG. 1*e*, it has been determined that forces F1 and F2, resulting from interactions between ink streams 32*a*, 32*b* from end nozzle 36 and adjacent inner nozzle 38, and acting in a direction perpendicular to ink streams 32*a*, 32*b*, are principally responsible for printed ink drop 23 misalignment, in the slow scan direction, of ink 30 ejected by end nozzle 36. This can be contrasted with aerodynamic drag forces which act in a direction parallel to the ink drop path, as described above. Additionally, it has been discovered that in high-density printing applications, adequate correction of drop misplacement in the slow scan direction derives from principles understood from Bernoulli's Theorem, the application of which describes forces F1, F2 acting in a direction perpendicular to the direction of drop motion.

Forces F1, F2 originate from interactions occurring between ink streams ejected from adjacent nozzles. The moving ink streams cause flow of air in air volumes between adjacent streams that perturbs the motion of the ink streams. These interactions are dominated primarily by pressure forces perpendicular to the nozzle path (aerodynamic lift) as compared to pressure forces parallel to the ink jet path (aerodynamic drag). This can be understood by examination of Bernoulli's theorem, which states that at any point in a tube through which liquid is flowing, the sum of the pressure energy, potential energy and kinetic energy is constant. For example, using Bernoulli's formula, if p is pressure; h, height above a reference plane; d, density of the ink; v, velocity of the flow; then $p+\frac{1}{2}dv^2=\text{constant}$. The dependence on height h can be disregarded in this case because gravity effects can be neglected at the drop size scales for inkjet printing (typically, drop sizes are less than 50 microns in diameter). Typically, the velocity of flow is measured along streamlines (described below).

Again, referring to FIG. 1*e*, it can be seen that a pressure gradient is generated across a streamline region 48*a* which encompass the ink stream 32*b* ejected by the end nozzle 36 because airflow is less on side 60 of streamline region 48*a* surrounding end ink stream 32*b* than it is on side 62 of the streamline region 48*a* surrounding end ink stream 32*b*. The streamline region 32*b* is shaped similarly to unbalanced air volume 44, because of the strong coupling of airflow to the ink stream 32*b*. As such, the pressure is greater on side 60 of streamline region 48*a* surrounding end ink stream 32*b* than it is on side 62 of the streamline region 48*a* surrounding end ink stream 32*b*. Accordingly, the interactive forces F1 and F2, which are derived from the pressure on sides 60, 62 of streamline region 48*a* of ink stream 32*b*, are unbalanced so that the magnitude of F1 is greater and net force F1–F2 is directed toward side 62.

Along a streamline region 48*b*, surrounding an inner ink stream 32*a*, the pressures are substantially equal on sides 64 and 66 because the airflow induced by neighboring ink streams 32*a*, 32*b* is substantially symmetrical or equivalent on sides 64 and 66. The streamline region 48*b* is similar in shape to balanced air volume 42 because of the strong coupling of the airflow to the ink streams.

As the ink streams 32*a*, 32*b* and ink drops 34 move through streamline region 48*a* or 48*b*, forces act perpendicularly to the direction of motion of the fluid and in a line with the row of ink nozzles 36, 38. The forces F1, F2 on each side of the streamline region 48*a*, 48*b* are balanced at inner streams 32*a* but not balanced at the end nozzle streams 32*b*. The shape of the streamline region 48*a*, 48*b* depends on the air volume between the ink streams and generally mirrors the shape of the air volume.

The pressure gradient across streamline region 48*a* generates a force F1 directed toward side 62 of end ink stream 32*b* sufficient to displace ink 30 ejected from the end nozzle 36 toward ink 30 from an adjacent neighboring nozzle 38. Ink stream 32*b* and its associated ink drops 34 act as a structure(s) against which the net force (F1–F2) is applied. The net force (F1–F2) is applied along the trajectory 50 of the ink stream 32*b* and the ink drops 34 ejected from end nozzle 36. Magnitudes of the net force will vary with ink type, nozzle geometries, and operating parameters. Additionally, magnitudes of forces F1, F2 are generally larger for high density printheads having high drop ejection velocities because closely spaced neighboring streams, each moving rapidly, produce high air velocities. Although the above description describes two-dimensional calculations, the description does not change when three-dimensional calculations are used for nozzles in a row due to the symmetry of the airflow around the nozzles.

As described below, in order to compensate for the imbalance experienced by the end nozzles 36 in the slow scan direction, a portion of the printhead (the end nozzle location, nozzle plate geometry, the surface of the printhead, etc.) is configured to create conditions that compensate for the imbalance at the end nozzle 36. These configurations can include altering air volume between a stream ejected from an end nozzle and the stream ejected form an inner nozzle causing an altered force on the end stream due to altered airflow in the altered air volume; altering spatial location of the end nozzle, altering an angle of initial trajectory of the ink stream as it leaves the end nozzle, etc. The altered airflow includes altering the shape of the air volume between the stream ejected from the end nozzle the stream ejected form the adjacent inner nozzle. The altered air volume between the end stream and the adjacent inner stream is, typically, larger than the air volume between adjacent inner ink streams. Alternatively, an altered air volume can be employed, in combination with other modifications to the end nozzle of the nozzle array, to compensate for misplacement of printed ink drops on the recording medium.

Additionally, printheads having high density arrays operating at high speeds, using many types of inks, and various operating parameters (ink drop velocity, distance of printhead from recording medium, eyc.) can be configured to balance forces acting on end nozzles. For example, in a printhead having a linear array of substantially equally spaced nozzles, forces acting on individual ink drops and/or streams of ink can be controlled by the introduction of an altered air volume 46, etc., so that the printed drops of all nozzles, including the end nozzles, contact recording medium 22 in a substantially straight line with substantially equal spacing between the ink drops.

Referring to FIGS. 2–5, and 7*a*–7*b*, the embodiments made in accordance with the present invention provide a printhead portion 70 shaped to create a net force that interacts with ink 30 ejected from an end nozzle 36 such that the spacing, at a predetermined location 52 of printed ink drops 20, printed on recording medium 22, formed from ink ejected from end nozzle 36 and an adjacent inner nozzle 38, corresponds to the spacing of ink drops formed from ink ejected from two adjacent inner nozzles. The configuration of the printhead portion 70 includes providing an altered air volume between the end nozzle and an adjacent inner nozzle.

Figure 2:
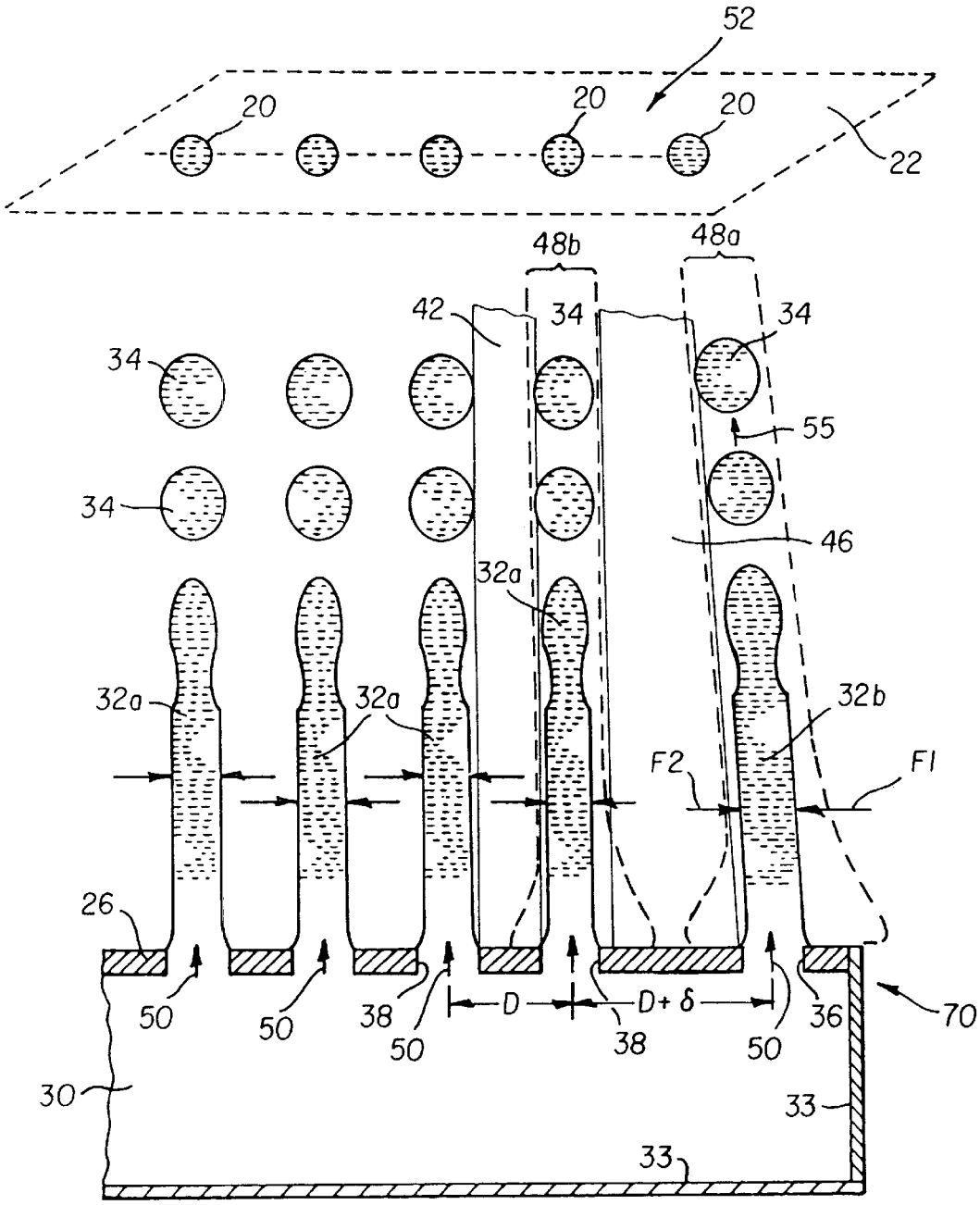
FIG. 2 is a cross-sectional view of a first embodiment made in accordance with the present invention.

Referring to FIG. 2, one embodiment of the present invention is shown. Altered air volume 46 is created by displacing end nozzle 36 a predetermined amount from its original location (shown in FIG. 1*d*). Specifically, the location of end nozzle 36 is modified by increasing the spacing in the slow scan direction (along the row of nozzles 36, 38) between end nozzle 36 and adjacent inner nozzle 38 by an amount δ incremental to the initial spacing D. The additional spacing δ is selected to be an amount required so that the Bernoulli forces calculated along a streamline region 48*b* in altered air volume 46 introduced between end nozzle 36 and adjacent inner nozzle 38 alter the trajectory of ejected ink stream 32*b* and ink drops 34 to cause printed ink drops 20 to land at desired location 52 (intersection of dotted lines in FIG. 2). Altered air volume 46 provides an additional volume of air between end nozzle 36 and adjacent inner nozzle 38 thereby increasing the total air volume present. The initial trajectory 50 of end streams 32*a*, 32*b*, that is the average stream velocity at the base of the stream, is still vertical in FIG. 2, as compared to FIG. 1*d*.

The incremental spacing δ aims the ink stream 32*b*, through its initial trajectory 50, to land at a location on the recording medium adjusted by an amount δ. However, the trajectory 50 is changed by the net force F1–F2 calculated along the streamline region 48*a* in altered air volume 46. The new trajectory 55 of ink 30 ejected by end nozzle 36 compensates for the additional spacing δ of end nozzle 36. As a result, end nozzle 36 prints ink drops 20 on a desired location 52 of the recording medium having a spacing D from the printed ink drop 20 ejected from adjacent inner nozzle 38. This corresponds to printed ink drop spacing D from inner nozzles 38 adjacent one another, and the above-described drop placement error E in the slow scan direction can be corrected. In addition, possible collisions between end drops and inner drops can be avoided.

The spacing δ is not the necessarily equivalent to the displacement error E of the printed drop of end nozzle 32*b* shown in FIG. 1*d* from its desired location.

The altered air volume 46 varies as a function of the height above the recording medium, the ink velocity and pressure, etc. Spacing δ can be predetermined by calculation using known parameters of the printhead and its operating parameters. Altered air volume 46 typically defines the streamline region 48*a*. If ink stream 32*b* from the relocated end nozzle 36 were to travel without Forces F1, F2, ink stream 32*b* would not provide printed drops 20 at desired location 52. As such, forces F1, F2 associated with altered air volume 46 pull back into alignment ink 34 ejected from end nozzle 36.

In this embodiment, the position of the end nozzle 36 is altered so that if the original end nozzle 36 (shown in FIG. 1*d*) and the end nozzle 36 (shown in FIG. 2) were both isolated from other nozzles, for example by blocking drop ejection from all other nozzles, end nozzles 36 would eject ink streams 32*b* and ink drops 34 substantially equivalent as to directionality, velocity, drop size etc.

Figure 3:
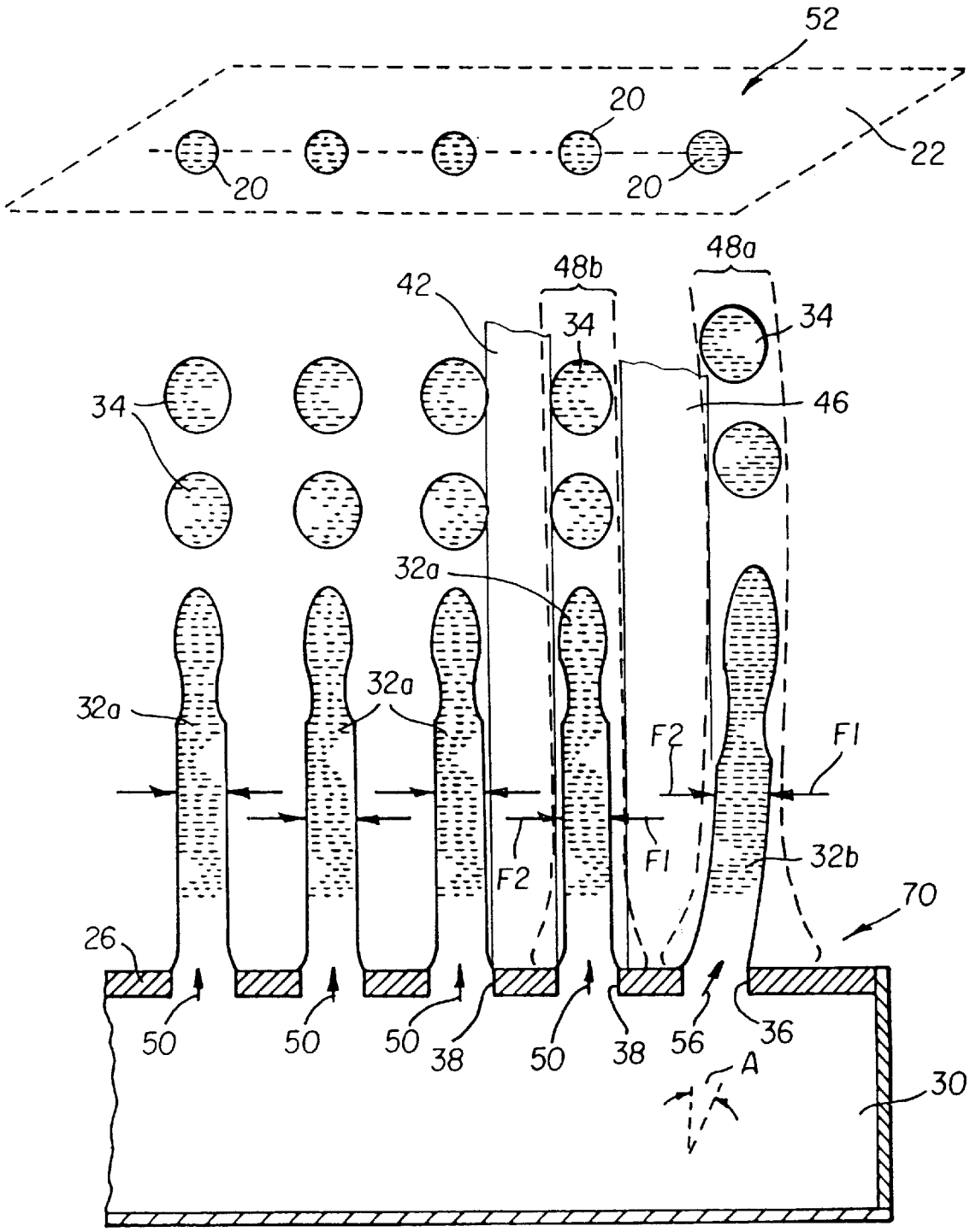
FIG. 3 is a cross-sectional view of an alternative embodiment made in accordance with the present invention.

In FIG. 3, another embodiment made in accordance with the present invention is shown. In this embodiment, the position of the end nozzle 36 is not altered but the design of end nozzle 36 is changed from its original design (shown in FIG. 1*d*), so that if the original end nozzle 36 and the end nozzle 36 (shown in FIG. 3) were both isolated from other nozzles, end nozzles 36 would eject ink streams 32 and ink drops 34 differently as to directionality in the plane shown in FIG. 3. End nozzle 36 is positioned at an angle relative to adjacent nozzle 38. The trajectory 56 of end nozzle 36 is angled away from adjacent nozzle 38. Ink 30 ejected from end nozzle 36 is initially aimed away from ink ejected from adjacent nozzle 38. This creates altered air volume 46. The angle 30 is selected to be of an amount sufficient so that the imbalance between the forces F1, F2 calculated from altered air volume 46 between the end nozzle 36 and adjacent inner nozzle 38 compensates for the initial angle of ejected ink 30.

The embodiment shown in FIG. 3 can be accomplished by canting the end nozzle 36 at a predetermined angle A away from the vertical, for example by making the bore of end nozzle 36 at an angle or by arranging for the region of the nozzle plate 26 surrounding the end nozzle 36 to be angled. The angle used is dependent on the design characteristics of the print head, and the actual position of the misplaced ink drops. Additionally, the angle can be accurately calculated as described below.

Figure 4:
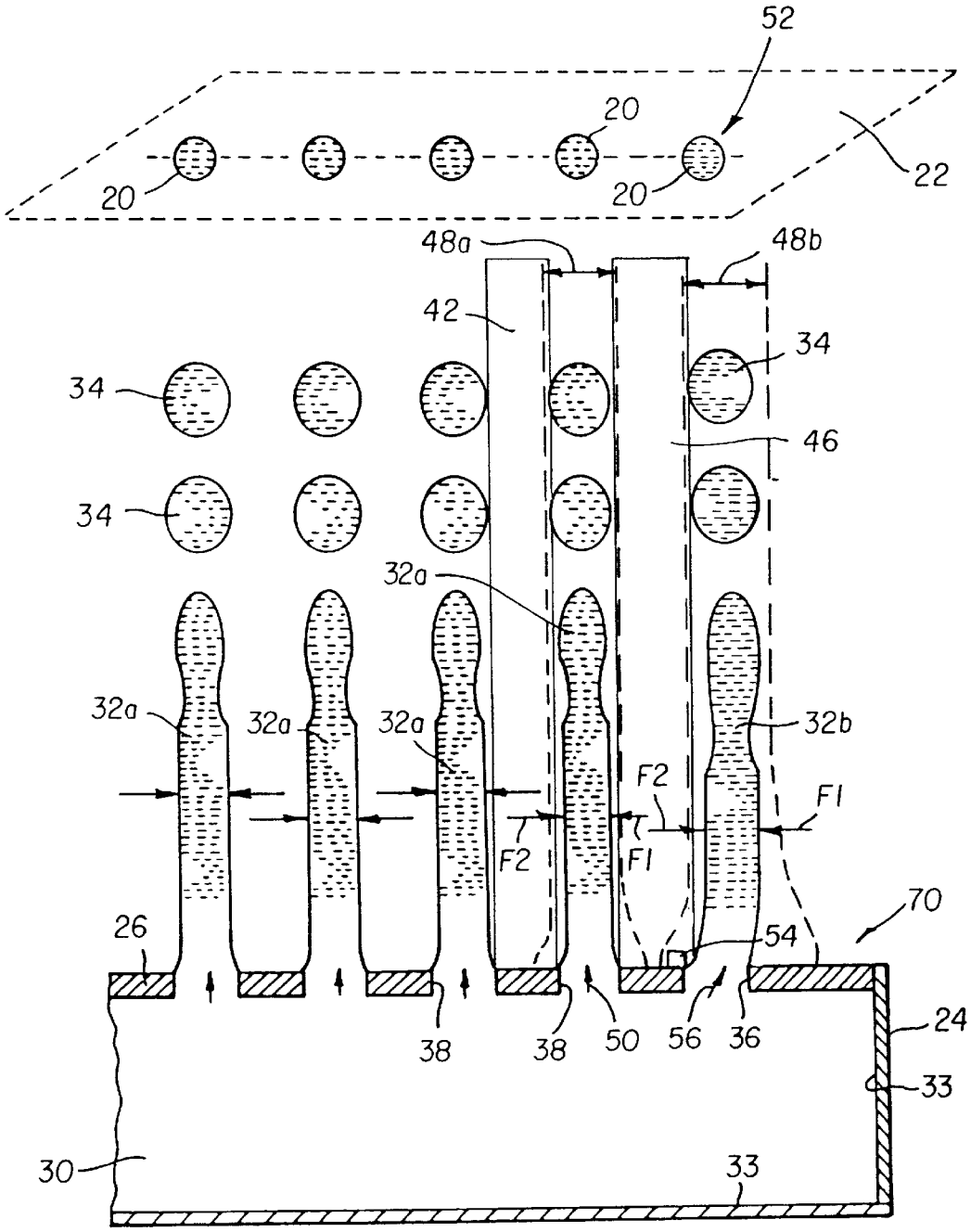
FIG. 4 is a cross-sectional view of an alternative embodiment made in accordance with the present invention.

Referring now to FIG. 4, another embodiment of the present invention is shown. This embodiment provides an alternate structure to cause the initial trajectory 56 of stream 32*b* to be angled away from adjacent inner stream 32*a*. Angular deflection of ink stream 32*b* is achieved by actuating a heating pad 54 positioned, proximate end nozzle 36 on a side of end nozzle 36 adjacent to inner nozzle 38. An asymmetric heater such as the one disclosed in U.S. Pat. No. 6,079,821 can be used. Heating pad 54 is oriented to create deflection of end nozzle 36 away from adjacent nozzle 38 in the plane of nozzles 36, 38. The heating pad 54 can be made by depositing a thin film resistive material on the printhead 24 and then passing a current through the resistive material in order to create deflection, etc.

The angle of deflection is selected to be of an amount sufficient so that the imbalance between the forces F1, F2 calculated for the altered air volume 46 between the end nozzle 36 and adjacent inner nozzle 38 compensates for the initial angle of ejected ink.

Figure 5:
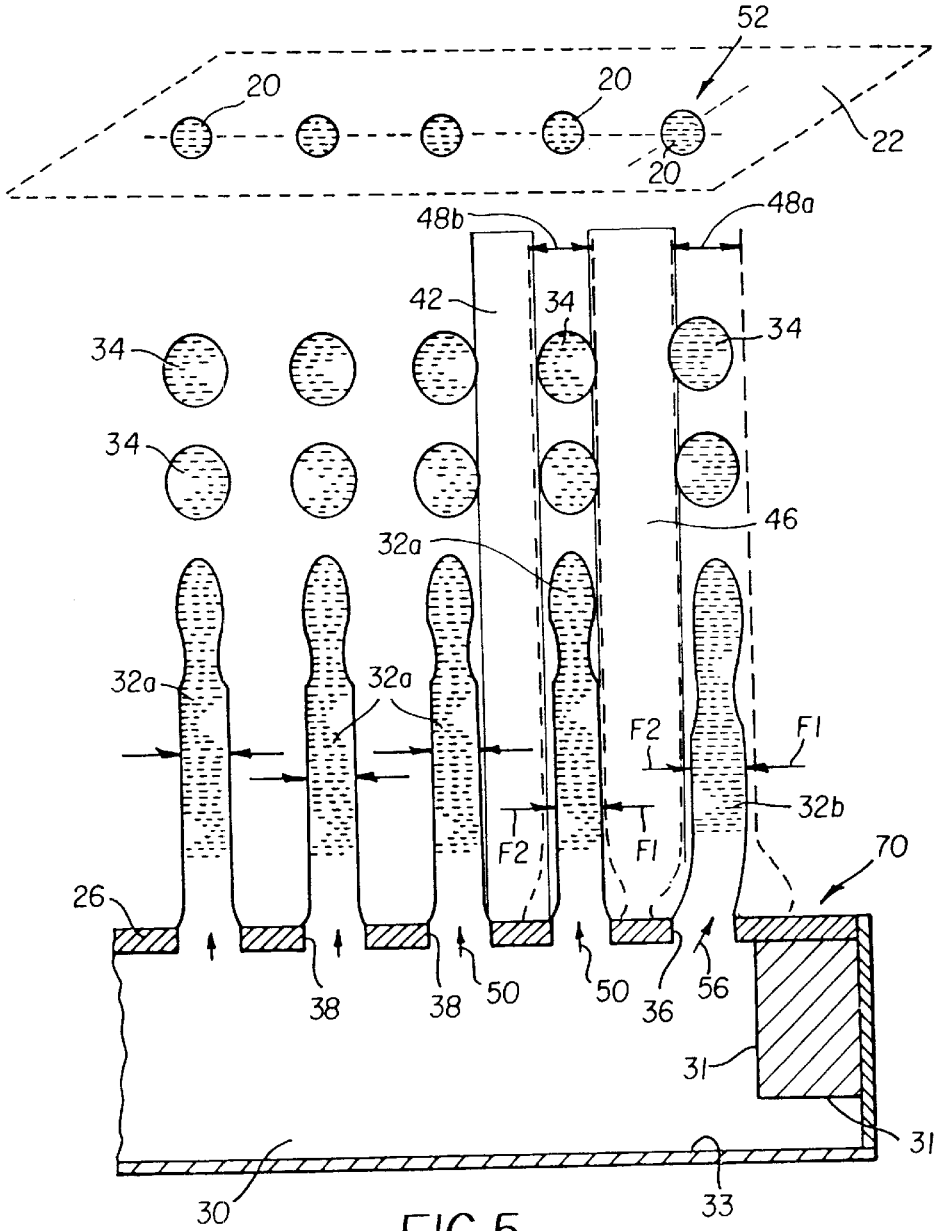
FIG. 5 is a cross-sectional view of an alternative embodiment made in accordance with the present invention.

Referring to FIG. 5, another embodiment of the present invention is shown. In this embodiment, the geometry of printhead portion 70 under nozzle plate 26 is altered so as to alter the initial trajectory 56 of the ink stream 32*b* ejected from end nozzle 36. This can be achieved by positioning an end wall 31 of ink delivery channel 33 relative to the location of end nozzle 36. It has been discovered that positioning end wall 31 close to end nozzle 36 can correct misalignment ink drops 34 ejected from end nozzle 36 in the slow scan direction.

Misplacement error E, typically a fraction of nozzle to nozzle spacing D, can be corrected by moving end wall 31 to a position of from about 2 to 10 microns away from a side of end nozzle 36. This produces an angulation of from about 0.1° to 1.0° of the initial trajectory 56 of the ink stream 32*b* ejected from end nozzle 36. The amount of angulation will also depend on ink stream velocity, ink pressure, nozzle size, temperature, ink viscosity, etc.

It has been found that the end wall 31 of the ink delivery channel 33, when closely spaced to the end nozzle 36, has an interactive effect on the direction in which the ink 30 is ejected from the end nozzle 36. In order to avoid unwanted initial ink stream deflection, end walls of the ink delivery channel 33 are normally spaced far enough away from the nozzles 36, 38 to avoid undesired interaction with ink stream, for example at a distance of 30 microns or more. However, by closely spacing the end wall 31 of ink delivery channel 33 to a side of end nozzle 36, for example at a spacing of 2 to 5 microns, a desired degree of angulation of the initial trajectory 56 of ink 30 ejected from end nozzle 36 is created that compensates for the unbalanced forces F1, F2 acting on the ink stream 32*b* and drops on ink 34 ejected from the end nozzle 36. Again, the angle of deflection is selected so that the imbalance between the forces F1, F2, calculated for streamline region 48*b* of altered air volume 46 between the end nozzle 36 and its adjacent inner nozzle 38, causes printed drops from end nozzle 36 to land in desire location 52.

A combination of displacing the position of end nozzle 36 from its initial location in conjunction with causing the initial trajectory 50 to be an angled initial trajectory 56, can also be used to correct misalignment of ink drops 34 ejected from end nozzle 36. In this case, the position of the end nozzle 36 is altered, for example by displacing the end nozzle 36 away from the adjacent nozzle 38 in the slow scan direction, and additionally the design of end nozzle 36 is changed from its original design so that the initial trajectory 56 of end nozzle 36 is angled. In this respect, the farther end nozzle 36 is moved away from adjacent inner nozzle 38, the less initial trajectory 56 need be angled away from adjacent inner nozzle 38. After a displacement greater than the displacement 6 described in the first embodiment, the initial trajectory 56 is angled toward adjacent inner nozzle 38.

In situations where misalignment is in the fast scan direction it has been discovered that the embodiments described above can also be used to correct misalignment in the fast scan direction. For example, if the initial trajectory 50 of an end nozzle 36 is angled in the fast scan direction, the resulting printed drop 20 will be displaced in the fast scan direction, specifically in the direction of motion of the printhead relative to the recording medium 22. Conversely, if the initial trajectory 50 of an end nozzle 36 is angled in direction opposite the fast scan direction, the resulting printed drop 20 will be displaced in the direction of motion of the recording medium 22 relative to the printhead. Thus, the angulation of initial trajectory 50 can be used to correct for a misalignment of printed drops from an end nozzle 36 not only in the slow scan direction but also in the fast scan direction.

Figure 6:
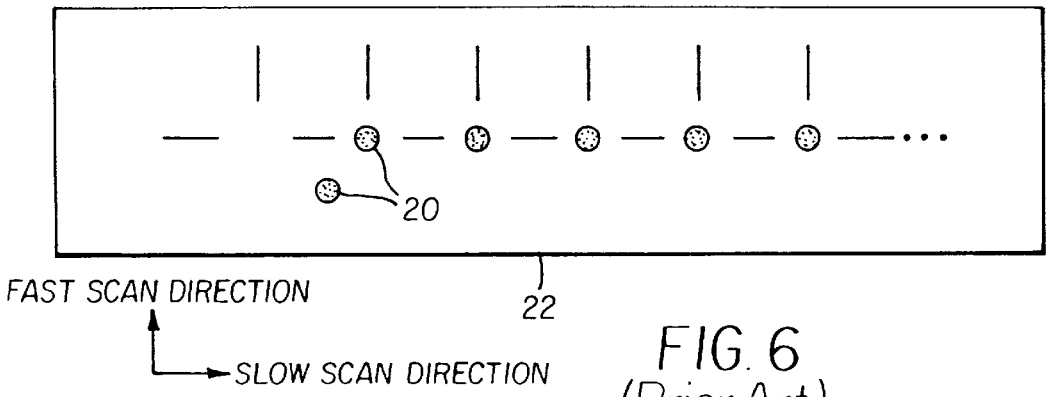
FIG. 6 (Prior Art)
FIG. 6 is a top view of printed ink drops showing end-drop misalignment in a fast scan direction and a slow scan direction.

Additionally, in situations where misdirection is in both the slow scan and fast scan direction, embodiments described above can be used to correct simultaneously for misalignment in both scan directions. FIG. 6 shows a top view of printed drops 20 on a recording medium 22 illustrating ink drop misalignment in both the slow and the fast scan directions. These misalignments are caused by a combination of aerodynamic drag and Bernoulli forces as separately described in the prior art and in the current invention, respectively.

Figure 7A:
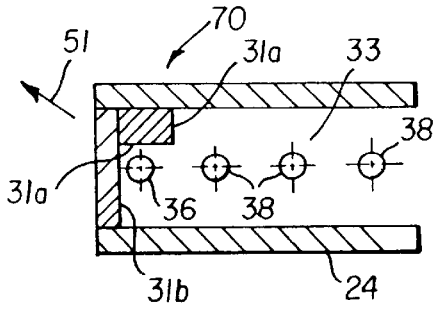
FIG. 7*a* is a top view of alternative embodiments made in accordance with the present invention correcting for ink drop misalignment in a slow and fast scan direction from an end nozzle.
Figure 7B:
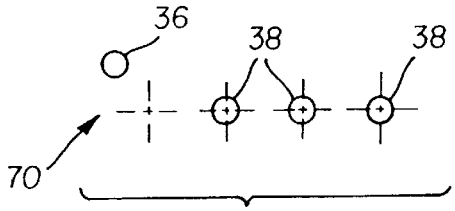
FIG. 7*b* is a top view of alternative embodiments made in accordance with the present invention correcting for ink drop misalignment in a slow and a fast scan direction from an end nozzle.

FIGS. 7*a* and 7*b* show embodiments which correct for the misalignment in both the slow scan and fast scan of FIG. 6. FIG. 7*a* shows two end walls 31*a*, 31*b*, each similar to end wall 31 discussed in FIG. 5, in top view, located close to end nozzle 36 in comparison with the location of ink delivery channel 33 in relation to inner nozzles 38, so as to correct for ink drop misalignment in both the slow and fast scan direction. As in the case discussed in FIG. 5, placement of end walls 31 causes angulation of initial trajectory 56 of ink streams 32*b* ejected from end nozzle 36. Direction 51 of the angulation of initial trajectory 56 is also away from the vertical direction (in FIG. 7*a*, the vertical direction is extending through end nozzle 36). In FIG. 7*b*, an end nozzle 36 displaced from the location it would have occupied if all nozzles were equally spaced and aligned in a row, similar to the displacement of end nozzle 36 described in the FIG. 2, so as to correct for ink drop misalignment in both the slow and fast scan directions.

The above described embodiments of the present invention can be fabricated using techniques known in the art of inkjet printhead manufacture including Micro-Systems-Technology (MST) fabrication techniques, semiconductor fabrication (CMOS) techniques, thin film deposition techniques, etc. For example, printhead 24 can be formed from a silicon substrate, and nozzles 36, 38 and can be etched in the substrate using plasma etching techniques, etc. Heating pad 54 can be made of polysilicon doped at a level of about thirty ohms/square, or thin film resistive heater materials such as Titanium Nitride can be used.

The present invention can also be implemented in various types of high-density ink jet printer designs that experience printed ink drop misalignment associated with end nozzles, for example, in conventional continuous inkjet apparatus utilizing electrostatic charging, in thermally steered continuous inkjet printers, etc. Additionally, it is specifically contemplated that the above described invention can be implemented in nozzle arrays having any number of nozzles.

The invention has been described in detail with particular reference to certain preferred embodiments thereof, but it will be understood that variations and modifications can be effected within the spirit and scope of the invention.

What is claimed is:

1. An inkjet printing apparatus comprising:

a source of ink; and a printhead having an end nozzle and a second nozzle adjacent to the end nozzle, a portion of the printhead being shaped to balance forces acting on the ink ejected from the end nozzle, the printhead having a third nozzle adjacent to the second nozzle, the third nozzle being spaced apart from the second nozzle by a first distance, wherein the portion of the printhead is shaped such that the end nozzle is positioned spaced apart from the second nozzle by a second distance, the second distance being greater than the first distance.

2. The inkjet printing apparatus according to claim 1, wherein the second distance is substantially equal to a distance that causes ink drops formed from the ink ejected from the end nozzle, the second nozzle, and the third nozzle to be substantially equally spaced apart at a location removed from the printhead.

3. The inkjet printing apparatus according to claim 2, wherein the location removed from the printhead includes a location on a receiver.

4. An inkjet printing apparatus comprising:

a source of ink; and a printhead having an end nozzle and a second nozzle adjacent to the end nozzle, a portion of the printhead being shaped to balance forces acting on the ink ejected from the end nozzle, the portion of the printhead including an ink deflection device positioned proximate to the end nozzle, wherein the ink deflection device is positioned on a surface of the printhead and includes a heating pad positioned such that ink ejected from the end nozzle is ejected in a direction away from the second nozzle as viewed from a plane substantially perpendicular to a plane defined by the ejected ink.

5. An inkjet printing apparatus comprising:

a source of ink; and a printhead having an end nozzle and a second nozzle adjacent to the end nozzle, a portion of the printhead being shaped to balance forces acting on the ink ejected from the end nozzle, the portion of the printhead including an ink deflection device positioned proximate to the end nozzle, the ink deflection device including a heating pad, wherein the heating pad is positioned such that ink ejected from the end nozzle is ejected in a direction away from the second nozzle as viewed from a plane substantially perpendicular to a plane defined by the ejected ink.

6. An inkjet printing apparatus comprising:

a source of ink;

a printhead having an end nozzle and a second nozzle adjacent to the end nozzle, the printhead including an ink delivery channel, a portion of the printhead being shaped to balance forces acting on the ink ejected from the end nozzle, the portion of the printhead including an end wall positioned proximate the end nozzle in the ink delivery channel, the end nozzle and the second nozzle forming a nozzle array, the end wall being positioned adjacent the end nozzle as viewed from a plane of the nozzle array, wherein the end wall is positioned at a distance from about 2 microns to about 10 microns from an edge of the end nozzle.

7. An inkjet printing apparatus comprising:

a source of ink; and a printhead having an end nozzle and a second nozzle adjacent to the end nozzle, a portion of the printhead being shaped to balance forces acting on the ink ejected from the end nozzle, wherein the forces acting on the ink ejected from the end nozzle are in a direction perpendicular to the ink.

8. The inkjet printing apparatus according to claim 7, wherein the portion of the printhead is shaped such that the end nozzle is positioned at an angle relative to the second nozzle.

9. The inkjet printing apparatus according to claim 7, wherein the portion of the printhead includes an ink deflection device positioned proximate to the end nozzle.

10. The inkjet printing apparatus according to claim 9, wherein the ink deflection device includes a heating pad.

11. The inkjet printing apparatus according to claim 9, wherein the ink deflection device is positioned on a surface of the printhead.

12. The inkjet printing apparatus according to claim 11, wherein the ink deflection device includes a heating pad.

13. The inkjet printing apparatus according to claim 7, the printhead including an ink delivery channel, wherein the portion of the printhead includes an end wall positioned proximate the end nozzle in the ink delivery channel.

14. The inkjet apparatus according to claim 13, the end nozzle and the second nozzle forming a nozzle array, wherein the end wall is positioned adjacent the end nozzle as viewed from a plane of the nozzle array.

15. The inkjet printing apparatus according to claim 13, wherein the end wall is at least partially positioned at a location on a first side of the end nozzle and the second nozzle is positioned on a second side of the end nozzle.

16. The inkjet printing apparatus according to claim 7, wherein the portion of the printhead includes an ink deflection device positioned such that ink ejected from the last nozzle is ejected in a direction away from the second nozzle as viewed from a plane substantially perpendicular to a plane defined by the ejected ink.

17. A printhead comprising:

a housing, portions of the housing defining a plurality of nozzle bores including an end nozzle bore and a second nozzle bore adjacent to the end nozzle bore, a portion of the housing shaped to balance forces acting on ink in a substantially perpendicular direction relative to a path of ink ejected through the end nozzle bore and the adjacent nozzle bore as viewed from a plane substantially perpendicular to a plane defined by the ejected ink.

18. The printhead according to claim 17, the housing defining an ink delivery channel, wherein the portion of the housing includes an end wall positioned proximate the end nozzle bore in the ink delivery channel.

19. The printhead according to claim 18, wherein the end wall is positioned adjacent the end nozzle bore at a location opposite the adjacent nozzle bore.

20. The printhead according to claim 18, wherein the end wall is at least partially positioned at a location on a first side of the end nozzle bore and the adjacent nozzle bore is positioned on a second side of the end nozzle bore.

21. The printhead according to claim 17, wherein the portion of the printhead includes an ink deflection device positioned proximate to the end nozzle bore.

22. The printhead according to claim 21, wherein the ink deflection device is positioned on a surface of the printhead.

23. The printhead according to claim 22, wherein the ink deflection device is positioned such that ink ejected from the end nozzle bore is ejected in a direction away from the adjacent nozzle bore.

24. The printhead according to claim 22, wherein the ink deflection device includes a heating pad.

25. The printhead according to claim 24, wherein the heating pad is at least partially positioned between the end nozzle bore and the adjacent nozzle bore.

26. The printhead according to claim 17, wherein the portion of the printhead includes an ink deflection device positioned such that ink ejected from the end nozzle bore is ejected in a direction away from the adjacent nozzle bore.

27. The printhead according to claim 17, wherein the portion of the printhead is shaped such that the end nozzle bore is positioned at an angle relative to the adjacent nozzle bore.

28. A printhead comprising:

a housing, portions of the housing defining a plurality of nozzle bores including an end nozzle bore and a second nozzle bore adjacent to the end nozzle bore, a portion of the housing shaped to balance forces acting in a substantially perpendicular direction relative to a path of ink ejected through the end nozzle bore and the adjacent nozzle bore as viewed from a plane substantially perpendicular to a plane defined by the ejected ink, portions of the housing defining an ink delivery channel, the portion of the housing including an end wall positioned proximate the end nozzle bore in the ink delivery channel, the end wall being positioned adjacent the end nozzle bore at a location opposite the adjacent nozzle bore, wherein the end wall is positioned at a distance from about 2 microns to about 10 microns from an edge of the end nozzle bore.

29. A printhead comprising:

a housing, portions of the housing defining a plurality of nozzle bores including an end nozzle bore and a second nozzle bore adjacent to the end nozzle bore, a portion of the housing shaped to balance forces acting in a substantially perpendicular direction relative to a path of ink ejected through the end nozzle bore and the adjacent nozzle bore as viewed from a plane substantially perpendicular to a plane defined by the ejected ink, the adjacent nozzle bore being a second nozzle bore, the printhead having a third nozzle bore adjacent to the second nozzle bore, the third nozzle bore being spaced apart from the second nozzle bore by a first distance, wherein the portion of the printhead is shaped such that the end nozzle bore is positioned spaced apart from the second nozzle bore by a second distance, the second distance being greater than the first distance.

30. The printhead according to claim 29, wherein the second distance is substantially equal to a distance that causes ink drops formed from the ink ejected from the end nozzle bore, the second nozzle bore, and the third nozzle bore to be substantially equally spaced apart at a location removed from the printhead.

31. The printhead according to claim 30, wherein the location removed from the printhead includes a location on a receiver.

32. A method of balancing forces acting on ink ejected from an end nozzle comprising:

providing a printhead having a plurality of nozzles including an end nozzle; and shaping a portion of the printhead such that forces acting on the ink ejected from the end nozzle are balanced such that ink drops formed from the ink ejected by the printhead are substantially equally spaced apart at a location removed from the printhead, wherein the forces act on the ink in a direction substantially perpendicular to the ejected ink.

33. The method according to claim 32, wherein shaping a portion of the printhead such that forces acting on the ink ejected from the end nozzle are balanced includes angling the portion of the printhead such that the end nozzle is positioned at an angle relative to a second nozzle.

34. The method according to claim 32, wherein shaping a portion of the printhead such that forces acting on the ink ejected from the end nozzle are balanced includes positioning an ink deflection device proximate to the end nozzle.

35. The method according to claim 34, wherein positioning an ink deflection device proximate to the end nozzle includes positioning the ink deflection device on a surface of the printhead.

36. The method according to claim 35, wherein the ink deflection device includes a heating pad.

37. The method according to claim 36, wherein positioning an ink deflection device proximate to the end nozzle includes positioning the ink deflection device such that ink ejected from the last nozzle is ejected in a direction away from a second nozzle as viewed from a plane substantially perpendicular to a plane defined by the ejected ink.

38. The method according to claim 32, wherein shaping a portion of the printhead such that forces acting on the ink ejected from the end nozzle are balanced includes providing the printhead with an ink delivery channel, and positioning an end wall in the ink delivery channel proximate to the end nozzle.

39. The method according to claim 38, wherein positioning an end wall in the ink delivery channel proximate to the end nozzle includes positioning the end wall adjacent to the end nozzle on a first side of the end nozzle with a second nozzle being positioned on a second side of the end nozzle.

40. The method according to claim 32, wherein the location removed from the printhead includes a location on a receiver.

41. A method of balancing forces acting on ink ejected from an end nozzle comprising:

providing a printhead having a plurality of nozzles including an end nozzle; and shaping a portion of the printhead such that forces acting on the ink ejected from the end nozzle are balanced such that ink drops formed from the ink ejected by the printhead are substantially equally spaced apart at a location removed from the printhead, wherein shaping a portion of the printhead such that forces acting on the ink ejected from the end nozzle are balanced includes increasing a first spacing distance between the end nozzle and a second nozzle, the second nozzle being adjacent to the end nozzle, the first spacing distance being relative to a second spacing distance between the second nozzle and a third nozzle, the third nozzle being adjacent to the second nozzle.

42. A method of balancing forces acting on ink ejected from an end nozzle comprising:

providing a printhead having a plurality of nozzles including an end nozzle; and shaping a portion of the printhead such that forces acting on the ink ejected from the end nozzle are balanced such that ink drops formed from the ink ejected by the printhead are substantially equally spaced apart at a location removed from the printhead, wherein shaping a portion of the printhead such that forces acting on the ink ejected from the end nozzle are balanced includes providing the printhead with an ink delivery channel, and positioning an end wall in the ink delivery channel proximate to the end nozzle and adjacent to the end nozzle on a first side of the end nozzle with a second nozzle being positioned on a second side of the end nozzle, the end wall being positioned at a distance from about 2 microns to about 10 microns from an edge of the end nozzle.

43. A printhead comprising:

a housing, portions of the housing defining a plurality of nozzle bores including an end nozzle bore and a second nozzle bore adjacent to the end nozzle bore, a portion of the housing shaped to balance forces acting in a substantially perpendicular direction relative to a path of ink ejected through the end nozzle bore and the adjacent nozzle bore as viewed from a plane substantially perpendicular to a plane defined by the ejected ink, the portion of the housing including an ink deflection device positioned proximate to the end nozzle, the ink deflection device including a heating pad, wherein the heating pad is positioned such that ink ejected from the end nozzle is ejected in a direction away from the second nozzle as viewed from the plane substantially perpendicular to the plane defined by the ejected ink.

44. A method of balancing forces acting on ink ejected from an end nozzle comprising:

providing a printhead having a plurality of nozzles including an end nozzle and a second nozzle; and shaping a portion of the printhead such that forces acting on the ink ejected from the end nozzle are balanced such that ink drops formed from the ink ejected by the printhead are substantially equally spaced apart at a location removed from the printhead, wherein shaping a portion of the printhead such that forces acting on the ink ejected from the end nozzle are balanced includes providing an ink deflection device positioned proximate to the end nozzle, the ink deflection device including a heating pad, wherein the heating pad is positioned such that ink ejected from the end nozzle is ejected in a direction away from the second nozzle as viewed from a plane substantially perpendicular to a plane defined by the ejected ink.

* * * * *